US006879692B2

(12) United States Patent
Nielsen et al.

(10) Patent No.: US 6,879,692 B2
(45) Date of Patent: Apr. 12, 2005

(54) HEARING AID WITH A SELF-TEST CAPABILITY

(75) Inventors: Kim Hjortgaard Nielsen, Vipperoed (DK); Lars Baekgaard Jensen, Farum (DK)

(73) Assignee: Widex A/S, Vaerloese (DK)

( * ) Notice: Subject to any disclaimer, the term of this patent is extended or adjusted under 35 U.S.C. 154(b) by 129 days.

(21) Appl. No.: 09/899,991

(22) Filed: Jul. 9, 2001

(65) Prior Publication Data

US 2003/0007647 A1 Jan. 9, 2003

(51) Int. Cl.[7] ..... H04R 29/00
(52) U.S. Cl. ..... 381/60; 381/58; 381/23.1
(58) Field of Search ..... 381/60, 312, 58, 381/23.1; 600/559

(56) References Cited

U.S. PATENT DOCUMENTS 4,049,930 A * 9/1977 Fletcher et al. ..... 381/60
5,999,856 A * 12/1999 Kennedy ..... 607/57
6,118,877 A * 9/2000 Lindemann et al. ..... 381/60
2002/0039428 A1 * 4/2002 Svajda et al. ..... 381/331
2002/0057814 A1 * 5/2002 Kaulberg ..... 381/312

FOREIGN PATENT DOCUMENTS

DE 41 28 172 A1 3/1993

* cited by examiner

*Primary Examiner*—Xu Mei
*Assistant Examiner*—Con P. Tran
(74) *Attorney, Agent, or Firm*—Sughrue Mion, PLLC

(57) ABSTRACT

A hearing aid with a test controller for detection of a defect in the signal path of the hearing aid is provided. The test controller controls a test signal generator and a probe means for determination of a signal parameter, such as signal level, frequency spectrum, phase characteristic, auto-correlation, cross-correlation, etc. A set of signal switches controlled by the test controller is provided for connecting a desired test signal generator or a desired probe means to a desired point in the signal path for testing of a desired part of the hearing aid. Further signal switches are provided for coupling hearing aid components into and out of the signal path of the hearing aid.

23 Claims, 3 Drawing Sheets

HEARING AID WITH A SELF-TEST CAPABILITY

FIELD OF THE INVENTION

The present invention relates to a hearing aid having a self-test capability.

BACKGROUND OF THE INVENTION

It is well-known in the art of hearing aids that a large fraction of hearing aids turned in for repair later proves to operate correctly. Thus in many cases, a perceived problem with a hearing aid does not relate to a defect in the hearing aid, rather it relates to the actual adjustment and use of the hearing aid. A lot of time and other resources are wasted in shipping and diagnosing hearing aids that are not defect.

SUMMARY OF THE INVENTION

It is therefore desirable to provide a hearing aid with a self-test capability so that a defect in the hearing aid can be signaled to the operator of the hearing aid.

The operator of the hearing aid may be the hearing impaired user of the hearing aid or an audiologist fitting, fine twig or otherwise working with the hearing aid.

According to he present invention the above-mentioned and other objects are fulfilled by a hearing aid having at least one input transducer for transform an acoustic input signal into a first electrical sign a signal processor for compensating a hearing deficiency by generation of a second electrical signal based on the first electrical signal, an output transducer for conversion of the second signal into sound, and at least one probe means for determination of a signal parameter at a first point in the signal path of the hearing aid.

Further the hearing aid may comprise a test controller for detection of a defect in the signal path of the hearing aid. The test controller may be connected with and adapted to control at least one test signal generator, such as a tone generator, a noise generator, a digital word generator, etc, at least one probe means for determination of a signal parameter, such as signal level, frequency spectrum, phase characteristic, autocorrelation, cross-correlation, etc. and at least one signal switch provided in the hearing aid. The at least one signal switch is provided for connecting a desired test signal generator or a desired probe means to a desired point in the signal path for testing of a desired part of the hearing aid. Further signal switches may be provided for coupling hearing aid components into or out of the signal path of the hearing aid. The signal path is constituted by components and transmission paths of the hearing aid that receive and transmit signals that are derived from the first electrical signals of the hearing aid.

For example, the test controller may be adapted to control respective signal switches to disconnect all of the at least one input transducers from the signal path of the hearing aid and to activate a probe means for determination of the signal level at a selected or predetermined point in the signal path whereby the noise level generated by input circuitry of the hearing aid may be determined.

The value of a signal parameter as determined by the at least one probe means may be compared to a reference value that may be stored in a memory in the hearing aid. If the detected value lies outside a predetermined range comprising the reference value, it may be signaled to the operator of the hearing aid that the hearing aid comprises a defect. The type of defect may also be signaled. For example, a specific tone or a specific sequence of tones may be generated by the output transducer signaling that the hearing aid is defect to the hearing impaired user. A specific tone or a specific sequence of tones may correspond to a specific defect.

If the hearing aid is connected to a hearing aid programming device with a display, the fact that the hearing aid comprises a defect may be displayed on the display and, further, an indication of the type of defect may be displayed.

For example, if the noise level is greater than a predetermined reference value, it may be signaled that the hearing aid comprises a defect.

Typically, hearing defects vary as a function of frequency in a way that is different for each individual user. Thus, the processor is preferably divided into a plurality of channels so that individual frequency bands may be processed differently, e.g. amplified with different gains. Thus, the hearing aid according to the invention may further comprise a filter bank with bandpass filters for dividing the first electrical signal into a set of bandpass filtered first electrical signals, and wherein the processor is adapted to generate the second electrical signal by individual processing of each of the bandpass filtered first electrical signals and adding the processed electrical signals into the second electrical signal. The test controller may be adapted to selectively connect a desired test signal generator or a desired probe means to the output of a selected bandpass filter. For example, a probe means for level detection may be connected to the output of a selected bandpass filter in order to determine the noise level in a selected frequency band.

In one embodiment of the invention, a test signal generator is provided that is controlled by the test controller for generation of a desired electronic signal that is transmitted to the output transducer of the hearing aid for conversion into a sound signal. Typically, the hearing aid is situated in a compartment with hard walls so that a large part of the generated acoustic signal is received by the at least one input transducer. The test controller is further adapted to control a signal switch to connect a selected probe means, such as a level detector, etc, to one of the at least one input transducers for determination of a signal parameter, such as the signal level, of the respective generated first electrical signal.

The determined value of the signal parameter may be compared to a reference value that may be stored in a memory in the hearing aid, and if the detected value is less than the reference value, it may be signaled as previously described to the operator of the hearing aid that the hearing aid comprises a defect. The type of defect may also be signaled. For example, it may be displayed on the display of a programming device that the input port to the input transducer in question should be checked for ear wax.

The input transducer connected to the signal path may be the pick-up coil. The pick-up coil in the hearing aid may be tested in a way similar to the one described previously for an acoustic input transducer, since the output transducer typically generates a significant magnetic field that is picked up by the pick-up coil.

In an embodiment with a filter bank, the probe means may be connected to the output of a selected bandpass filter to determine signal level of the generated first electrical signal in the corresponding frequency band. The probe means may be sequentially connected to the outputs of more or all of the bandpass filters to determine the signal parameter in question in more or all frequency bands. In this way the frequency spectrum of the generated first electrical signal may be determined, or harmonic distortion may be determined. For example, the test controller may be adapted to connect a selected probe means for level detection to the output of a bandpass filter that comprises a third harmonic of the output of the test signal generator for determination of harmonic distortion.

Signal switches may be provided for connecting a test signal generator, such as a tone generator to the input of the signal processor, and for connecting a probe means to the output of the signal processor whereby the gain of the signal processor may be determined. Further, the gain of the signal processor may be determined as a function of the frequency.

Further, the compression of the signal processor, i.e. gain as a function of input level may be determined, e.g. as a function of frequency.

It is well known to include an adaptive feedback loop comprising an adaptive filter in the hearing aid to compensate for acoustic feedback. Acoustic feedback occurs when the input transducer of a hearing aid receives and detects the acoustic output signal generated by the output transducer. Amplification of the detected signal may lead to generation of a stronger acoustic output signal and eventually the hearing aid may oscillate. The adaptive filter estimates the transfer function from output to input of the hearing aid including the acoustic propagation path from the output transducer to the input transducer. The input of the adaptive filter is connected to the output of the hearing aid and the output signal of the adaptive filter is subtracted from the input transducer signal to compensate for the acoustic feedback. A hearing aid of this type is disclosed in U.S. Pat. No. 5,402,496.

The test controller may be adapted to verify operation of the adaptive feedback loop, e.g. the test controller may control a signal switch to disconnect the feedback loop from the signal path and increase the gain of the signal processor until oscillation occurs. Preferably, the hearing aid is situated in the compartment with hard walls during this test. The test controller may further be adapted to reconnect the adaptive feedback loop to the signal path whereby oscillation should seize if the adaptive feedback loop operates correctly.

In general, the hearing aid may comprise a test signal generator for injection of a digital signal at a selected second point in the digital part of the signal path of the hewing aid, e.g. at the input of the signal processor.

In response to the signal injected at the second point a hearing aid without defects will generate a signal with certain parameter values at the selected first point in the signal path. The parameters may relate to frequency, amplitude, spectrum, modulation, phase, etc, and the parameter values of a hearing aid operating without defects are desired values. The test controller may further be adapted to compare the parameter values of the actual response signal with the desired values to determine whether the hearing aid comprises a defect. If an actual value lies outside a predetermined range comprising the respective desired value, it may be concluded that the hearing aid in question comprises a defect. The presence of a defect may be signaled to the operator of the hearing aid as previously described.

The self-test may be initiated upon user activation of at least one switch positioned on the hearing aid housing, or on a hearing aid programming device, or on a remote control unit for the hearing aid, or on a fitting system, etc. Preferably two switches has to be activated simultaneously or sequentially to avoid accidental activation of the self-test.

BRIEF DESCRIPTION OF THE DRAWING

Still other objects of the present invention will become apparent to those skilled in the art from the following description wherein the invention will be explained in greater detail. By way of example, there is shown and described a preferred embodiment of this invention. As will be realized, the invention is capable of other different embodiments, and its several details are capable of modification in various, obvious aspects all without departing from the invention. Accordingly, the drawings and descriptions will be regarded as illustrative in nature and not as restrictive. In the drawing.

DETAILED DESCRIPTION OF PREFERRED EMBODIMENTS

Figure 1:
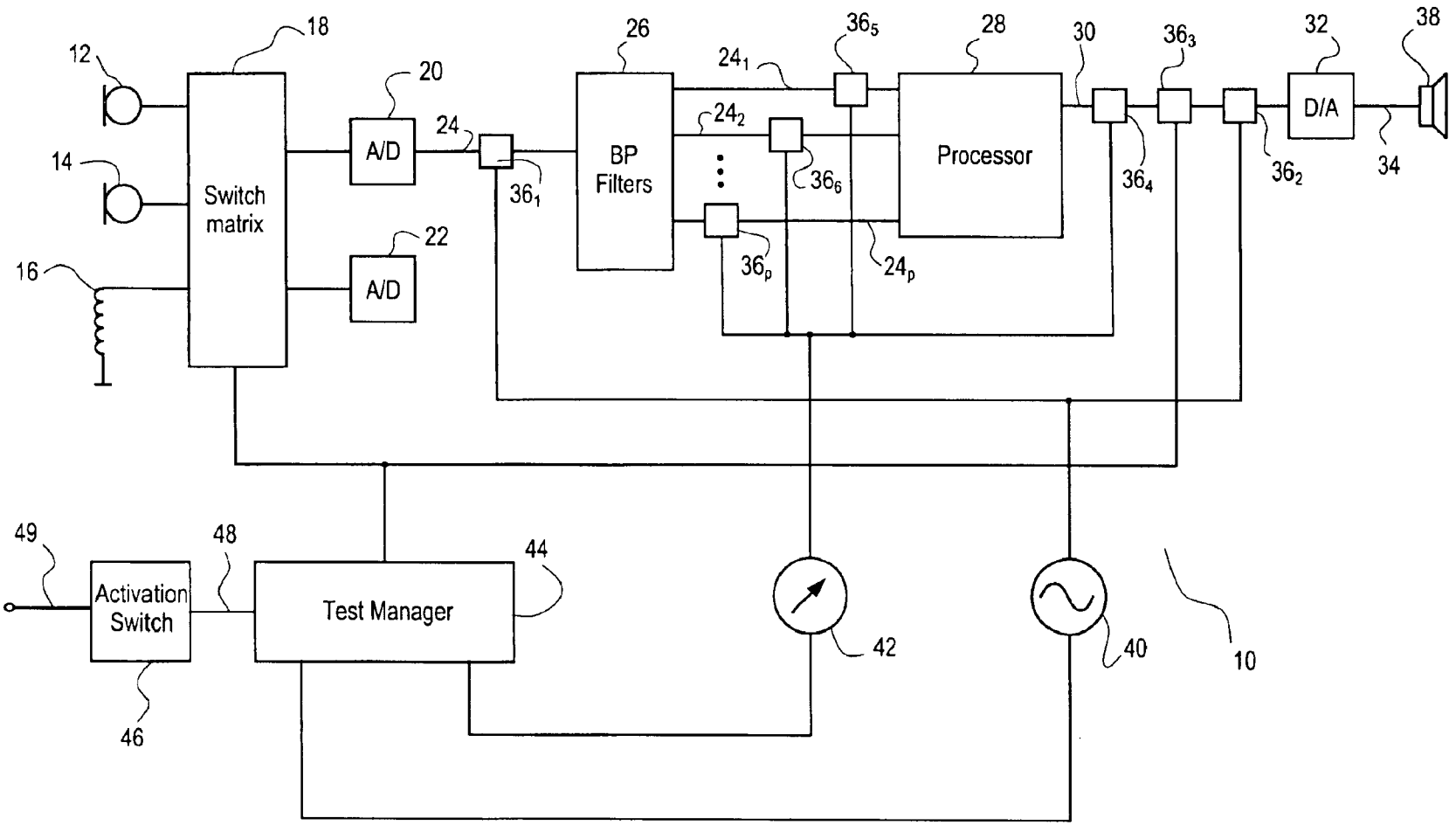
FIG. 1 shows a blocked schematic of a hearing aid according to the present invention.

FIG. 1 shows a hearing aid 10 having two input microphones 12, 14 and a pick-up coil 16. A signal switch matrix 18 selectively connects any of the input transducers 12, 14, 16 to a desired A/D converter 20, 22. For simplicity, the connections of the output of the second A/D converter 22 are not shown. The output signal 24 from A/D converter 20 is split into a set of bandpass filtered signals $\mathbf{24}_1, \mathbf{24}_2, \ldots, \mathbf{24}_n$ by a set 26 of bandpass filters. The processor 28 is divided into a plurality of channels so that individual frequency bands may be processed differently, e.g. amplified with different gains. The processor 28 generates the second electrical signal 30 by individual processing of each of the bandpass filtered first electrical signals $\mathbf{24}_1, \mathbf{24}_2, \ldots, \mathbf{24}_n$ and adding the processed electrical signals into the second electrical signal 30. A D/A converter 32 converts the digital output signal 30 to an analog signal 34. An output transducer 38 converts the analog signal 34 into sound.

It will be obvious for the person skilled in the art that the circuits indicated in FIG. 1 may be realized using digital or analogue circuitry or any combination hereof. In the present embodiment digital signal processing is employed and thus, the signal processor 28 and the filter bank 26 are digital sisal processing circuits. In the present embodiment, all the digital circuitry of the hearing aid 10 may be provided on a single digital signal processing chip or, the circuitry may be distributed on a plurality of integrated circuit chips in any appropriate way.

Signal switches $\mathbf{36}_1, \mathbf{36}_2, \ldots, \mathbf{36}_p$ are provided throughout the signal path of the hearing aid circuitry for connecting a test signal generator 40, e.g., a tone generator 40, or a probe means 42, e.g. a level detector 42, to the respective points in the signal path of the hearing aid 10. A test controller 44 controls the settings of the signal switches $\mathbf{36}_1, \mathbf{36}_2, \ldots, \mathbf{36}_p$ for detection of a defect in the signal pat of the hearing aid 10. For simplicity, the control lines connecting the test controller 44 with each of the respective signal switches $\mathbf{36}_1, \mathbf{36}_2, \ldots, \mathbf{36}_p$ are not shown in FIG. 1. The test controller 44 further controls the signal switch matrix 18 for connecting microphones 12, 14 and pick-up coil 16 to and disconnecting them from the signal path of the hearing aid 10. Further, the test controller 44 is adapted to control the test signal generator 40, e.g. to generate an electrical signal of a selected frequency, e.g. 1 kHz, e.g. with a selected amplitude and/or frequency modulation, and to control the probe means 42 for determination of a selected signal parameter, such as the rms value. For example noise level in frequency band 2 may be determined by the test controller 44 controlling the signal switch matrix 18 to disconnect all of the input transducers 12, 14, 16 from the A/D converters 20, 22 and connecting the level detector 40 to the output $24_2$ of a bandpass filter $26_2$. In general, the test controller 44 may control the signal switch $36_1$ to connect the test signal generator 40 to the input of the signal processing circuitry 26, 28 and simultaneously disconnecting the input from other signal sources, and the signal switch $36_4$ to connect the probe means 42 to the output of the signal processor 28 facilitating test of any of the signal processing algorithms performed in the signal processing circuitry 26, 28. For a given test signal generated by the test signal generator 40, signal parameters of the output signal generated by the signal processor without any defects in response to the test signal may be stored in a memory (not shown) in the hearing aid 10, and the test controller 44 may compare the parameters of the actually generated output signal of the signal processor 28 with like corresponding stored parameters in order to determine whether the hearing aid 10 comprises a defect.

A signal switch $36_3$ for interrupting the signal 30 before the signal switch $36_2$ and controlled by the test controller 44 is also provided. Having interrupted the signal 30, the test controller activates the tone generator 40 to generate a signal of a select frequency, e.g. 1 kHz, that is transmitted to the output transducer 38 of the hearing aid 10 for conversion into a sound signal. During the test the hearing aid 10 is situated in a compartment with hard walls so that a large part of the generated acoustic signal is received by the at least one input transducer 12, 14. The test controller 44 further controls signal switch 36, to connect probe means 42 to one of the at least one input transducers 12, 14 for determination of the signal level of the respective generated first electrical signal in the respective frequency band i.

The self-test is initiated upon reception of a signal 48 from the activation means 46. The activation means may be constituted by one or more switches positioned on file housing of the hearing aid 10 or the activation means may comprise interface means that is adapted to receive a command 49 for initiation of the self-test from an external device, such as a remote control unit, a hearing aid programming device 50, a fitting device, a personal computer, etc.

Figure 2:
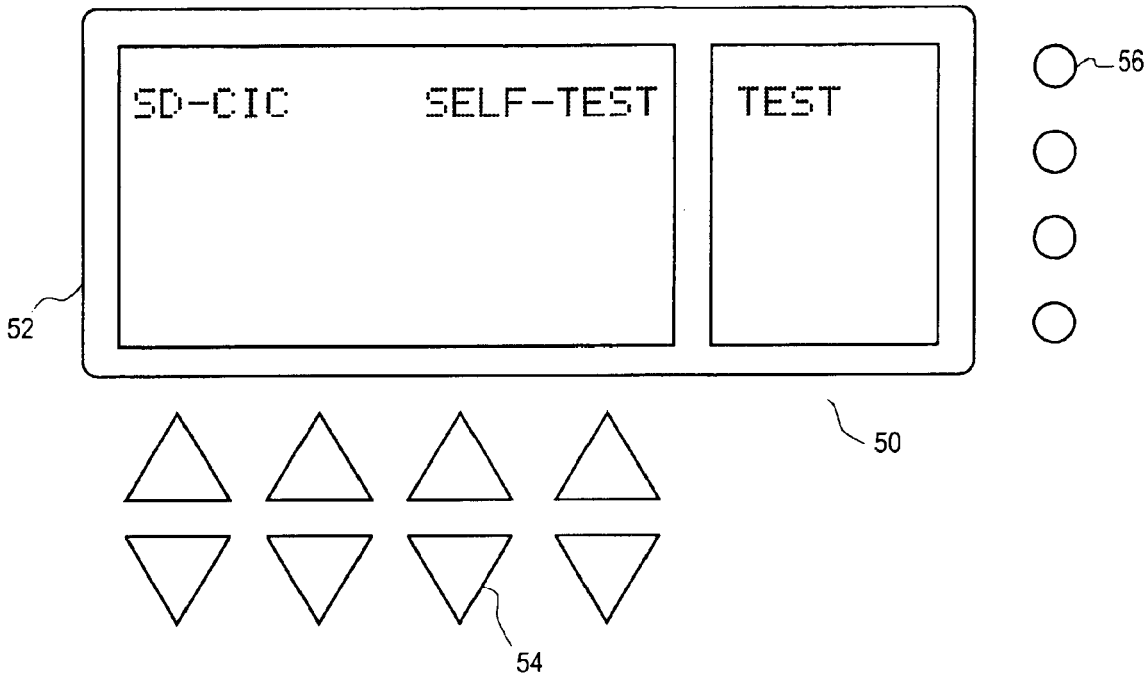
FIGS. 2–5 show self-test messages as displayed on a programming device for the hearing aid according to the present invention.
Figure 3:
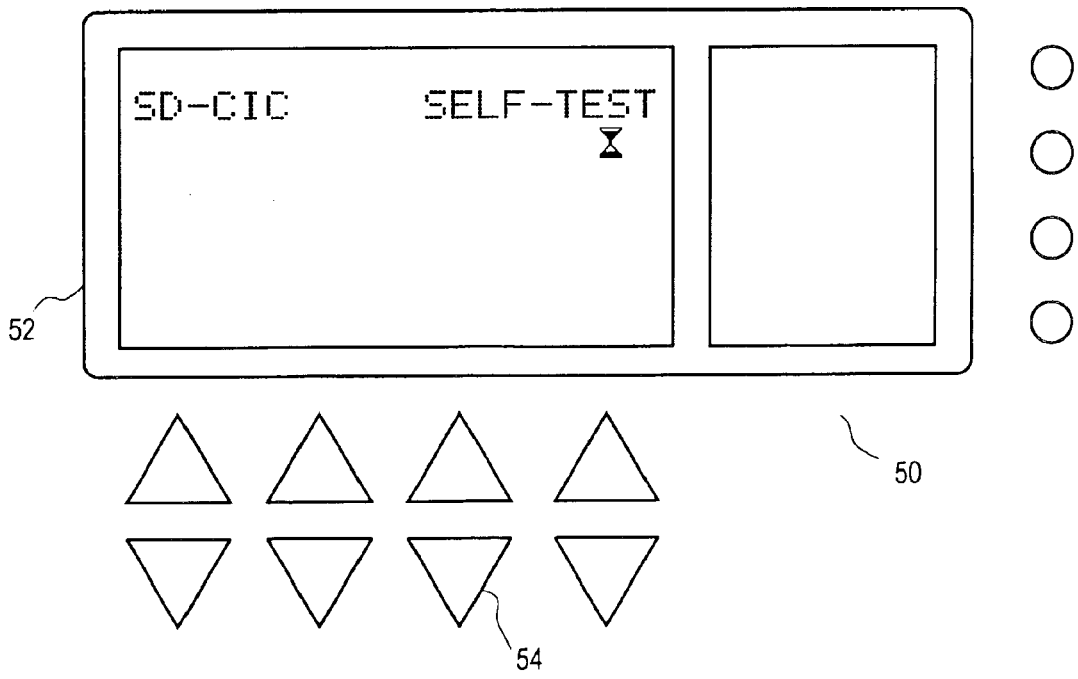
Figure 4:
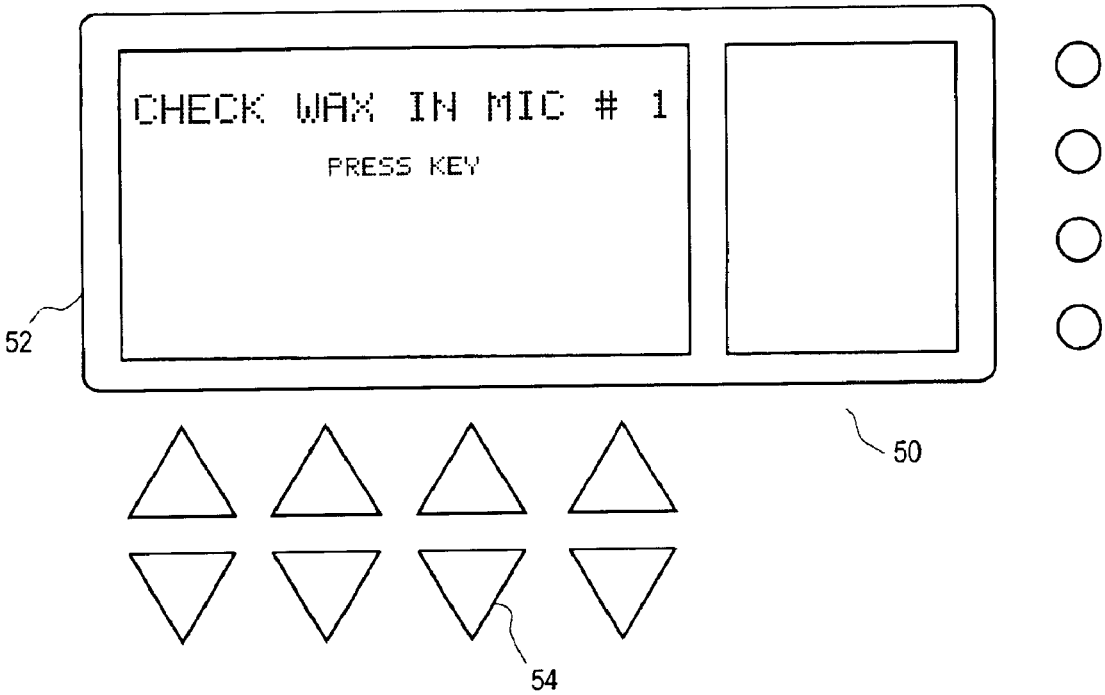
Figure 5:
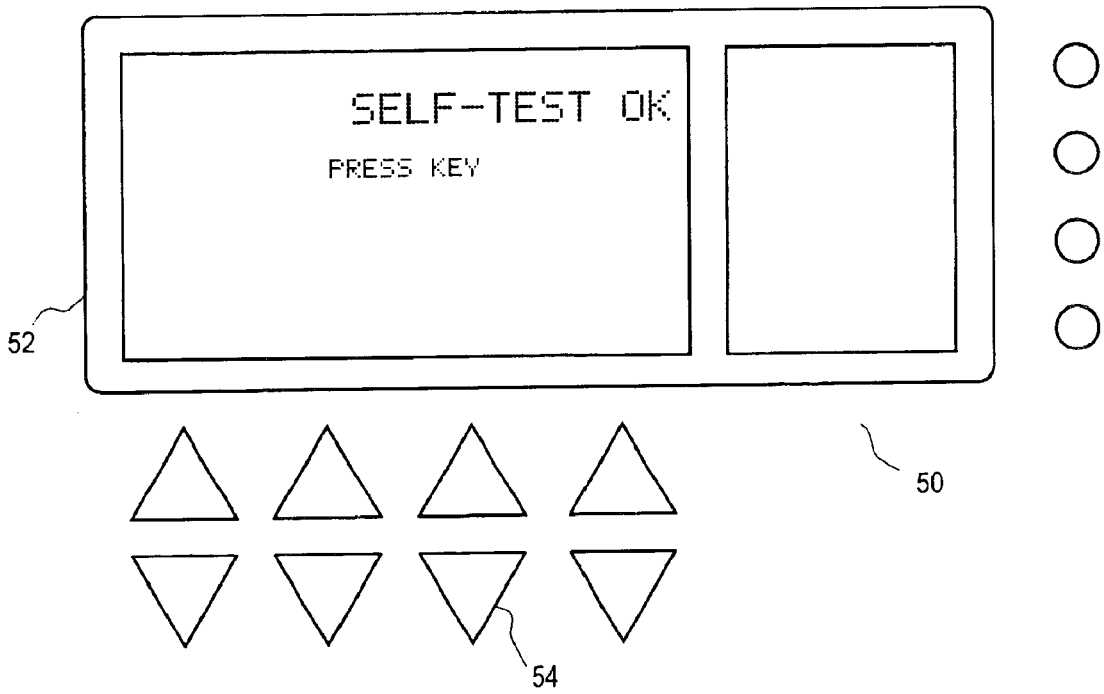

For example, the hearing aid 10 may be connected to a hearing aid programming device 50 with a display 52. The operator may initiate the self-test by pressing a specific key or set of keys 54 on the programming device 50. Then the device 50 displays that it is ready to perform a self-test as shown in FIG. 2. The self-test is performed upon activation of key 56. The programming device transmits a corresponding command to the activation means 46 of the hearing aid 10 and indicates that the self-test is in progress as shown in FIG. 3. The test described in the previous section may reveal that no second signal is generated by one of the microphones 12, 14. A probable cause may be that the input port to the microphone has been occluded by ear wax, thus the operator is asked to check if this is the problem in FIG. 4. If no problems have been revealed during the self-test a corresponding message is displayed as shown in FIG. 5.

The input transducer connected to the signal path may be the pick-up coil 16. The pick-up coil 16 in the hearing aid 10 may be tested like an acoustic input transducer 12, 14, since the output transducer 38 typically generates a significant magnetic field that is picked up by the pick-up coil 16.

The test controller 44 controls the signal switch matrix 18 to disconnect all of the input transducers 12, 14, 16 from the signal path, and connects the test signal generator 40 to the signal path through signal switch $36_1$. The probe means 42 is connected to the output of the signal processor 28 through signal switch $36_4$. By controlling the test signal generator 40 to generate a sequence of signals with different frequencies, the gain of the signal processor 28 is deterred as a function of the frequency.

Further, the compression of the signal processor 28, i.e. gain as a fraction of input level may be determined, e.g. as a function of frequency.

What is claimed is:

1. A hearing aid comprising an input transducer for transforming an acoustic input signal into a first electrical signal, a filter bank with bandpass filters for deriving from the first electrical signal a set of bandpass filtered derivatives of the first electrical signal, a signal processor for individual processing of each of the bandpass filtered derivatives of the first electrical signal and adding together the processed electrical signals to provide a second electrical signal based on the first electrical signal, an output transducer for converting the second signal into sound, a probe adapted for being selectively connected to the outputs of each one of said bandpass filters for determining a respective signal parameter, a test signal generator adapted for injecting a test signal at a selected point in the signal path of the hearing aid extending through said input transducer, said signal processor and said output transducer, a test controller adapted to control a state of the hearing aid, to receive an input from said probe and to determine any defect in the hearing aid, and activation means for operator activation in order to cause said test controller to initiate a test procedure.

2. The hearing aid according to claim 1, wherein said test controller is adapted to disconnect said input transducer from the signal path and to activate said probe for determination of the signal parameter in order that the noise level generated by input circuitry of the hearing aid may be determined.

3. The hearing aid according to claim 1, wherein said test controller is adapted to compare the input from said probe with desired parameters in order to establish whether the hearing aid has a defect.

4. The hearing aid according to claim 1, wherein said test signal generator is connected to effect the emission by said output transducer of a sound signal.

5. The hearing aid according to claim 4, wherein said test controller is adapted to connect said probe to said input transducer.

6. The hearing aid according to claim 1, wherein said test controller is adapted to verify the gain of said signal processor.

7. The hearing aid according to claim 1, wherein said test controller is adapted to verify the gain of said signal processor as a function of frequency.

8. The hearing aid according to claim 1, wherein said test controller is adapted to verify the compression of said signal processor.

9. The hearing aid according to claim 1, wherein said activation means comprises a switch positioned at a housing of the hearing aid.

10. The hearing aid according to claim 1, wherein said activation means comprises an interface adapted to receive commands from a remote control device adapted to operate the hearing aid.

11. The hearing aid according to claim 1, wherein said activation means comprises an interface adapted to receive commands from a programming device adapted to program the hearing aid.

12. The hearing aid according to claim 1, wherein said activation means comprises an interface adapted to receive commands from a fitting device for the hearing aid.

13. The hearing aid according to claim 1, comprising a memory for storage of a reference value of a parameter.

14. The hearing aid according to claim 1, comprising means for causing generation by said output transducer of a tone signal to alert the user that the hearing aid has a defect.

15. The hearing aid according to claim 14, wherein said test controller is adapted to determining a specific type of defect, and comprising means for causing generation by said output transducer of a specific tone signal to alert the user that the hearing aid has a specific defect.

16. The hearing aid according to claim 1, comprising at least two switches in said signal path for the selective determination of signal parameters at respective points of said signal path.

17. The hearing aid according to claim 1, comprising at least two switches in said signal path for the selective injecting of test signals at respective points of said signal path.

18. A hearing aid comprising, an input transducer for transforming an acoustic input signal into a first electrical signal, a signal path including a signal processor for processing the first electrical signal to produce a second electrical signal based on the first electrical signal, an output transducer for converting the second signal into sound, a probe for determining a signal parameter, means for connecting said probe to a first point in said signal path, a test controller adapted to control a state of the hearing aid, to receive an input from said probe and to determine any defect in the hearing aid, activation means for operator activation in order to cause said test controller to initiate a test procedure, a test signal generator controlled by said test controller and adapted for injecting a test signal at a second point in the signal path, and a filter bank with bandpass filters for deriving from the first electrical signal a set of bandpass filtered derivatives of the first electrical signal, wherein said processor is adapted to generate the second electrical signal by individual processing of each of the bandpass filtered derivatives of the first electrical signal and adding together the processed electrical signals to provide the second electrical signal, and wherein said test controller is adapted to selectively connect said probe to the output of one of said bandpass filters.

19. The hearing aid according to claim 18, wherein said test controller is adapted to connect said probe to the output of a bandpass filter tuned to pick the third harmonic of the output of said test signal generator for determination of harmonic distortion.

20. A hearing aid comprising a telecoil input transducer for transforming an input signal into a first electrical signal, a signal path including a signal processor for processing the first electrical signal to produce a second electrical signal based on the first electrical signal, an output transducer for converting the second signal into sound, a probe for determining a signal parameter, means for connecting said probe to a first point in said signal path, a test controller adapted to control a state of the hearing aid, to receive an input from said probe and to determine any defect in the hearing aid, activation means for operator activation in order to cause said test controller to initiate a test procedure, and a test signal generator controlled by said test controller and adapted for injecting a test signal at a second point in the signal path, wherein said second point is selected to achieve that the test signal effects the emission by said output transducer of a sound signal, and wherein said output transducer is adapted to generate a magnetic field, that is picked up by said telecoil input transducer.

21. A hearing aid comprising an input transducer for transforming an acoustic input signal into a first electrical signal, a signal path including a signal processor for processing the first electrical signal to produce a second electrical signal based on the first electrical signal, an output transducer for converting the second signal into sound, a probe for determining a signal parameter, means for connecting said probe to a first point in said signal path, a test controller adapted to control a state of the hearing aid, to receive an input from said probe and to determine any defect in the hearing aid, activation means for operator activation in order to cause said test controller to initiate a test procedure, and an adaptive feedback canceller for suppression of acoustic feedback, wherein said test controller is adapted to verify the operation of said adaptive feedback canceller.

22. The hearing aid according to claim 21, comprising a filter bank with bandpass filters for deriving from the first electrical signal a set of bandpass filtered derivatives of the first electrical signal, wherein said processor is adapted to generate the second electrical signal by individual processing of each of the bandpass filtered derivatives of the first electrical signal and adding together the processed electrical signals to provide the second electrical signal, and wherein said test controller is adapted to selectively connect said probe to the output of one of said bandpass filters.

23. The hearing aid according to claim 21, wherein said test controller is adapted to disconnect said input transducer from the signal path.

* * * * *